United States Patent [19]

Yamamoto

[11] Patent Number: 4,472,069

[45] Date of Patent: Sep. 18, 1984

[54] MINATURE ELECTRONIC APPARATUS HAVING ALARM SOUND GENERATING FUNCTION

[75] Inventor: Haruo Yamamoto, Sayama, Japan

[73] Assignee: Casio Computer Co. Ltd., Tokyo, Japan

[21] Appl. No.: 467,449

[22] Filed: Feb. 17, 1983

Related U.S. Application Data

[63] Continuation of Ser. No. 203,360, Nov. 3, 1980, abandoned.

[30] Foreign Application Priority Data

Nov. 12, 1979 [JP] Japan ..... 54-145369

[51] Int. Cl.[3] ..... G04B 21/00

[52] U.S. Cl. ..... 368/273; 84/1.03; 340/384 E; 368/251

[58] Field of Search ..... 340/384 E, 384 R; 84/1.03; 368/75, 251, 272, 273; 364/569

[56] References Cited

U.S. PATENT DOCUMENTS

| | | | |
|---|---|---|---|
| 4,055,843 | 10/1977 | Whitaker | 340/384 E |
| 4,060,973 | 12/1977 | Martino | 368/245 |
| 4,073,133 | 2/1978 | Earls et al. | 340/384 E X |
| 4,090,349 | 5/1978 | Takase | 340/384 E X |
| 4,104,865 | 8/1978 | Sasaki | 340/384 E X |
| 4,185,283 | 1/1980 | Clark | 340/384 E X |
| 4,271,495 | 6/1981 | Scherzinger et al. | 368/75 |

FOREIGN PATENT DOCUMENTS

| | | |
|---|---|---|
| 2013376 | 8/1979 | United Kingdom . |
| 2022880 | 12/1979 | United Kingdom . |
| 2035624 | 6/1980 | United Kingdom . |
| 1574486 | 9/1980 | United Kingdom . |

OTHER PUBLICATIONS

"Signal Processor for Speech Synthesis is Programmable", Electronics Review, pp. 41/42, Oct. 11, 1979.

JP-Abstract 53-133468 (Ikeda), Jan. 22, 1979, vol. 3, No. 6, of Patents Abstracts of Japan.

*Primary Examiner*—John W. Caldwell, Sr.

*Assistant Examiner*—Daniel Myer

*Attorney, Agent, or Firm*—Frishauf, Holtz, Goodman & Woodward

[57] ABSTRACT

A miniaturized electronic apparatus having an alarm sound generating function comprises an alarm sound data memory, in which alarm sound data for a plurality of different alarm sounds are memorized. Peculiar alarm sounds can be preset for each season or month or weekday so that upon reaching of an alarm time in the corresponding season or month or on the corresponding weekday it is selectively read out from the memory to produce the corresponding alarm sound from a sound generator. A designated order of the plurality of different alarm sounds can also be set in the apparatus.

6 Claims, 6 Drawing Figures

MINATURE ELECTRONIC APPARATUS HAVING ALARM SOUND GENERATING FUNCTION

This is a continuation of application Ser. No. 203,360 filed Nov. 3, 1980, now abandoned.

BACKGROUND OF THE INVENTION

This invention relates to miniaturized electronic apparatus such as electronic miniature calculators and electronic wristwatches having a calculator function and, more particularly, to miniaturized electronic apparatus, with which a peculiar alarm sound can be selected from a plurality of different memorized alarm sounds for each season or month or weekday.

Recently, miniaturized electronic apparatus having timepiece function and alarm function are commercially available. As the miniaturized electronic apparatus having alarm function, there is one, which has an alarm function of producing as an alarm sound not a single-tone sound but sound of continuously varying tones, for instance a piece of music. Such a music producing apparatus, however, has a deficiency that it produces only a fixed memorized piece of music, which may sometimes fail to meet the taste of the user or may soon be boring.

An object of the invention is to provide a miniaturized electronic apparatus, which has an alarm function of producing a peculiar one of a plurality of different memorized alarm sounds for each season or month or weekday at the detection of an alarm time.

SUMMARY OF THE INVENTION

To achieve the above objective, the miniaturized electronic apparatus according to the invention comprises a memory means memorizing alarm sound data for producing a plurality of different alarm sounds, an alarm sound data reading means for selecting the plurality of different alarm sounds one after another in a predetermined order for each season or month or weekday and reading out the alarm sound data corresponding to the selected alarm sound from the memory means, and a means for producing alarm sound according to the alarm sound data read out by the alarm sound data reading means.

Since according to the invention a peculiar alarm sound among a plurality of different memorized alarm sounds is produced for each season or month or weekday, it is possible to hear sound which is varied for each season or month or weekday. In addition, desired alarm sound can be selected, for instance through operation of ten keys, so that the user can obtain an alarm sound meeting his taste.

DETAILED DESCRIPTION

Now, an embodiment of the invention applied to an electronic calculator which has a function of producing music as an alarm sound will be described with reference to the accompanying drawing.

Figure 1:
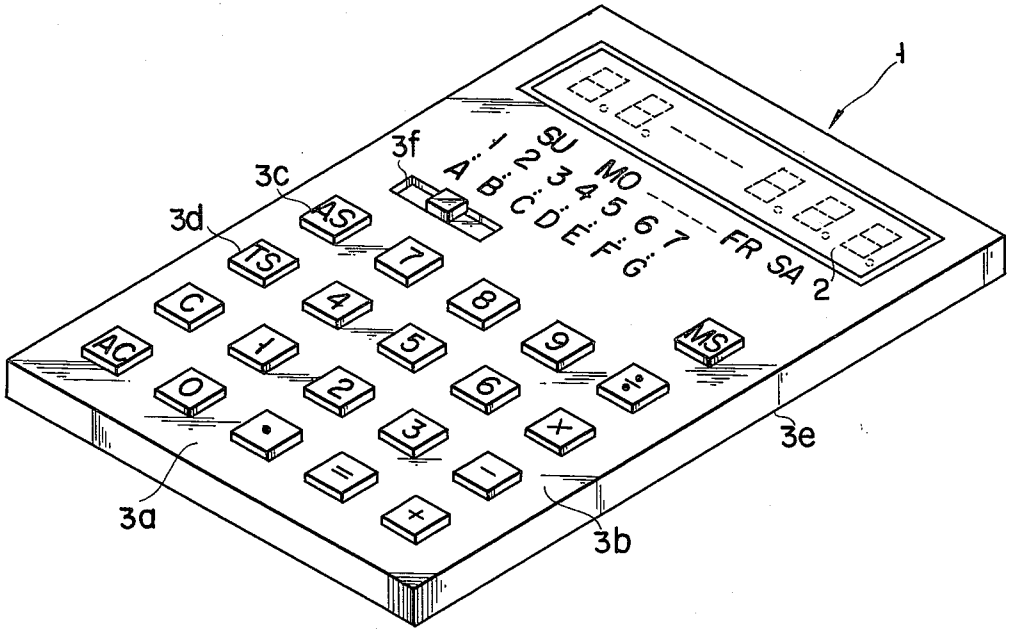
FIG. 1 is a perspective view showing an embodiment of the invention applied to an electronic calculator.

FIG. 1 is a perspective view of the electronic calculator having a function of producing music. In FIG. 1, designated at 1 is a calculator housing having a digital display section 2 formed on the front side. On a lower portion of the front of the calculator housing there are provided numeral keys 3*a* comprising ten keys "0" to "9" and a decimal point key "." for coupling numerical data, an addition key "+", function keys 3*b* comprising a subtraction key "−", a multiplication key "×" and a division key "÷" for species calculations, a clear key "C" and an all clear key "AC", an alarm time setting key "AS" 3*c*, a time setting key "TS" 3*d* and a music selection key "MS" 3*e*. Also, a slidable mode selection switch 3*f* for setting various modes is provided on the front of housing 1. This mode selection switch 3*f* has an "OFF" position, at which power is not supplied, a "C" position, at which the calculator is in a calculator mode, and a "W" position, at which the calculator is in a watch mode. Further, on the front of calculator housing 1 and under the digital display section 2, characters representing weekdays, namely "Su" for Sunday, "Mo" for Monday, . . . , "Sa" for Saturday, are provided by means of printing at positions corresponding to decimal points in the digital display section 2.

On the front of calculator housing 1 are further provided by means of printing numerals "1" to "7" and under these numerals characters "A" to "G" referring respectively to different numbers of music. These numbers of music can be selected by operating ten keys of the corresponding numerals "1" to "7".

Figure 2:
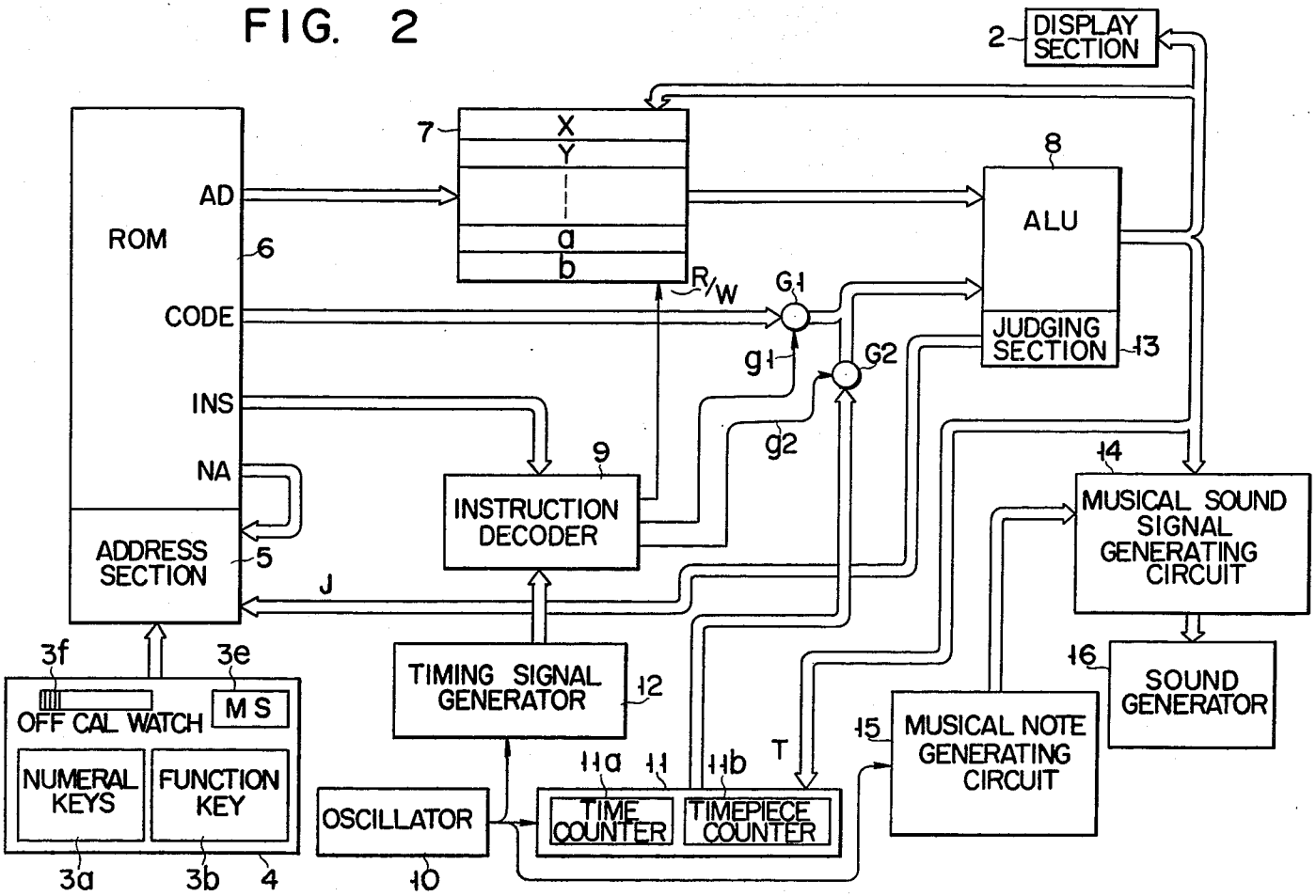
FIG. 2 is a schematic showing the whole circuit construction of the same embodiment.

FIG. 2 shows the circuit construction of the calculator. In FIG. 2, reference numeral 4 designates a keying section, in which the aforementioned ten keys, the aforementioned various function keys and mode selection key 35 are provided. The keyed instruction signals and mode specification signal produced from the keying section 4 are coupled to an address section 5 for giving an ROM (read only memory) 6 address specification. The ROM 6 accommodates microprograms for controlling the operation of the calculator in various modes and musical codes for the music numbers "A" to "G", and it supplies address data AD, code data CODE, instruction data INS and next address data NA as parallel data according to the address specification by data produced from the address section 5. The address data AD are produced to give an RAM (random access memory) 7 address specification. The writing and reading of data in and out of the RAM 7 are effected with respect to register bits specified by the address data AD. The code data CODE are coupled through a first gate $G_1$ to an ALU (arithmetic unit) 8. The instruction data INS is coupled to an instruction decoder 9, and the next address data NA is coupled as next address specification signal to the ROM 6.

The RAM 7 is constituted by an X register for calculation and display, a Y register for auxiliary calculation, an a register for alarm time registration, a b register for selected music number registration and other registers (not shown). Data read out from the X and Y registers in the RAM 7 are supplied to the ALU 8 for predetermined calculations therein, and the results of calculations are transferred to and stored in the X and Y registers and other registers in the RAM 7. Data in the X register are coupled through the ALU to the digital display section 2 for digital display therein.

Reference numeral 10 designates an oscillator for producing a reference frequency signal, which is supplied to a timepiece circuit 11. The timepiece circuit 11 includes a time counter 11*a* for producing time data, a weekday counter 11*b* for producing weekday data and a date counter (not shown). The time data obtained from the timepiece circuit 11 is coupled through a gate $G_2$ to an ALU 8 in the watch mode. At the time of setting time in the timepiece circuit 11, the set time data is temporarily stored in the X register by keying operation to be described hereinafter, and then set time data T from the X register is transferred through the ALU 8 to the timepiece circuit 11.

The reference frequency signal from the oscillator 10 is also supplied to a timing signal generator 12. The timing signal generator 12 produces various timing signals on the basis of the reference frequency signal, these signals being supplied to an instruction decoder 9. The instruction decoder 9 decodes the aforementioned instruction data INS, the signal obtained thus obtained is supplied as control signal to various circuits, and it is also supplied as gate control signal $g_1$ to the first gate $G_1$, gate control signal $g_2$ to the second gate $G_2$ and write/read signal R/W to the RAM 7.

The calculations in the ALU 8 in the calculator mode are carried out as ordinary four rules calculations of input data and, if necessary, effecting carry function, whereby a judge signal J is produced by a judging action of a judging section 13 provided in the ALU 8 and is supplied to the address section 5 as address conversion data for the ROM 6.

In the watch mode, the judging section 13 compares the time data coupled from the a register to the ALU 8 and time data coupled from the time counter 11*a*, and when it detects the coincidence of these data it determines the weekday represented by the weekday data coupled from the weekday counter 11*a* to the ALU 8. As a result, among start address data in the b register one corresponding to the determined weekday is read out and coupled as judge signal J to the address section 5 for causing an address shift in the ROM 6. With this address shift, the ROM 6 produces a musical code corresponding to the first sound of a given number of music, the musical code thus provided being coupled as code data CODE through the ALU 8 to a musical sound signal generating circuit 41.

The reference frequency signal from the oscillator 10 is further supplied to a musical note generating circuit 15. The musical note generating circuit 15 produces a musical note signal corresponding to a given musical note on the basis of the reference frequency signal, the musical note signal thus produced being coupled to the musical sound signal generating circuit 14. The musical sound signal generating circuit 14 produces a given musical sound signal on the basis of the musical code from the ALU 8 (i.e., code data CODE) and the musical note signal coupled from the musical note generating circuit 15, the musical sound signal thus produced being coupled to a sound generator 16 such as a loudspeaker.

Figure 3:
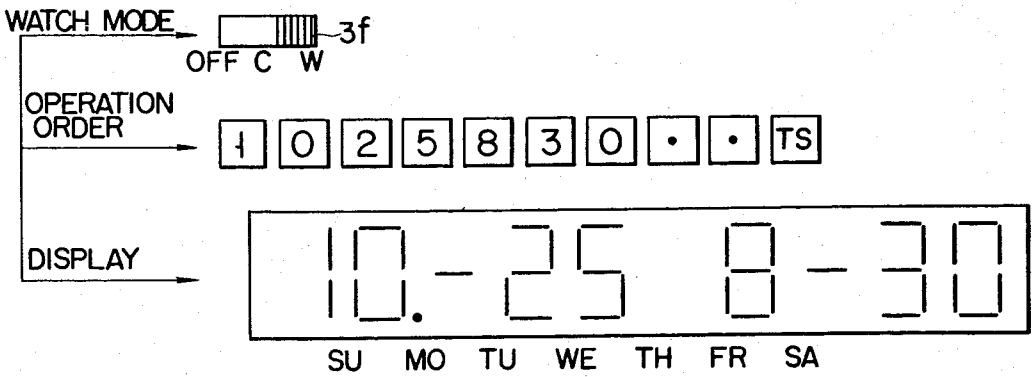
FIG. 3 is a view showing a keying operation for setting time in a timepiece circuit and a state of display of set time.

Now, the operation of this embodiment will be described with reference to FIGS. 3 to 6. First, the operation involved in the setting of time in the timepiece 11 will be described. FIG. 3 shows the relevant keying procedure and the resultant display state. In the first place, the mode selection switch 35 is set to the watch mode "W" position. If the time to be set is "October 25, 8 o'clock and 30 minutes, Monday", the ten keys, "1", "0", "2", "5", "8", "3" and "0" are successively operated in the mentioned order in this state, thus coupling data corresponding to "October 25, 8 o'clock and 30 minutes". The weekday data is set by operating the decimal point key ".". For Monday, this key is operated twice. Finally, the time setting key "TS" 3*d* is operated. As a result, mode specification signal and key input signal are supplied from the keying section 4 to the address section 5, and necessary microcommands for the time setting operation among the data AD, CODE, INS and NA are produced from the ROM 6. At this time, the instruction decoder 9 produces the first gate control signal $g_1$ to open the first gate $G_1$. The setting data from the ROM 6 are coupled through the ALU 8 to and temporarily memorized in the X register in the RAM 7, and then they are read out from the X register and transferred through the ALU 8 to the timepiece circuit 11. Thus, the content of the timepiece circuit 11 is corrected to "1025830 . . . " or concretely "October 25, 8 o'clock and 30 minutes, Monday". At the same time, the setting data from the ALU 8 are supplied to the digital display section 2. Thus, "10-25 8-30" is displayed as shown in FIG. 3. Also, a decimal dot at a position corresponding to the impression of the characters "Mo" is driven to indicate Monday.

Figure 4:
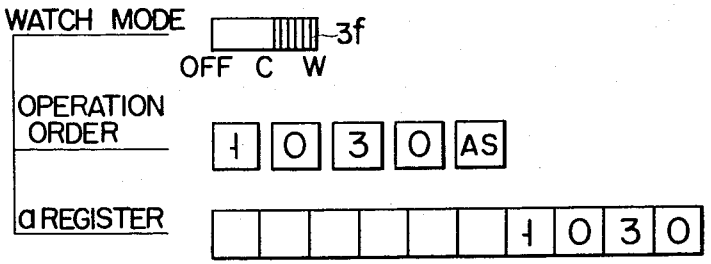
FIG. 4 is a view showing a keying operation for setting alarm time and the state of setting of the alarm time in an a register.

Now, the procedure for and the operation involved in setting an alarm time in the a register of the RAM 8 will be described with reference to FIG. 4. In this case, the mode selection switch 35 is set in the watch mode position "W". For setting an alarm time, for instance "10:30", in this state, the ten keys "1", "0", "3" and "0" are successively operated in the mentioned order, and then an alarm time setting key "AS" 3*c* is operated. As a,result, alarm time data is produced from the ROM 6 to be coupled through the ALU 8 to the X register in the RAM 7 and temporarily memorized therein before being transferred to the a register. In this way, data "1030" are successively set in predetermined bits of the a register as shown in FIG. 4.

On the basis of the alarm time set in this way, alarm sound is produced at 10 o'clock and 30 minutes every day. The selection of the piece of music to be produced as alarm sound is made in a manner as shown in Table below.

TABLE

| | | | | | | | |
|---|---|---|---|---|---|---|---|
| Key (ten key) operated | 1 | 2 | 3 | 4 | 5 | 6 | 7 |
| Selected number of music | A | B | C | D | E | F | G |
| Start address | $A_0$ | $B_0$ | $C_0$ | $D_0$ | $E_0$ | $F_0$ | $G_0$ |

Figure 5:
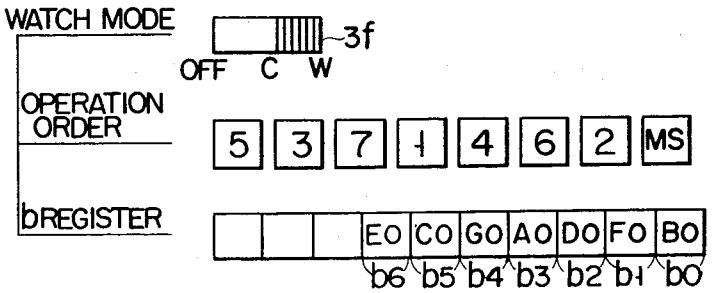
FIG. 5 is a view showing a keying operation for selecting music numbers and the state of setting of start addresses of the selected music numbers in a b register.

More particularly, for selecting number A the ten key "1" is operated, and for selecting number B the ten key "2" is operated. If it is desired to obtain as alarm sound number E on Sunday, number C on Monday, number G on Tuesday, number A on Wednesday, number D on Thursday, number F on Friday and number B on Saturday, then the ten key "5" for number E is first operated, and then the ten keys "3", "7", "1", "4", "6" and "2" for the respective numbers C, G, A, D, F and B are successively operated in the mentioned order. Finally, the music number selection key "MS" 3*e* is operated. As a result, the first musical sound address data $E_0$, $C_0$, $G_0$, $A_0$, $D_0$, $F_0$ and $B_0$ for the respective numbers C, G, A, D, F and B are produced from the ROM 6 and coupled through the ALU 8 to and temporarily memorized in the X register of the RAM 7, and then transferred to and memorized in the b register, as shown in FIG. 5.

Once the start address data for the individual music numbers are stored in the b register, a peculiar number can be produced as alarm sound for each weekday.

Figure 6:
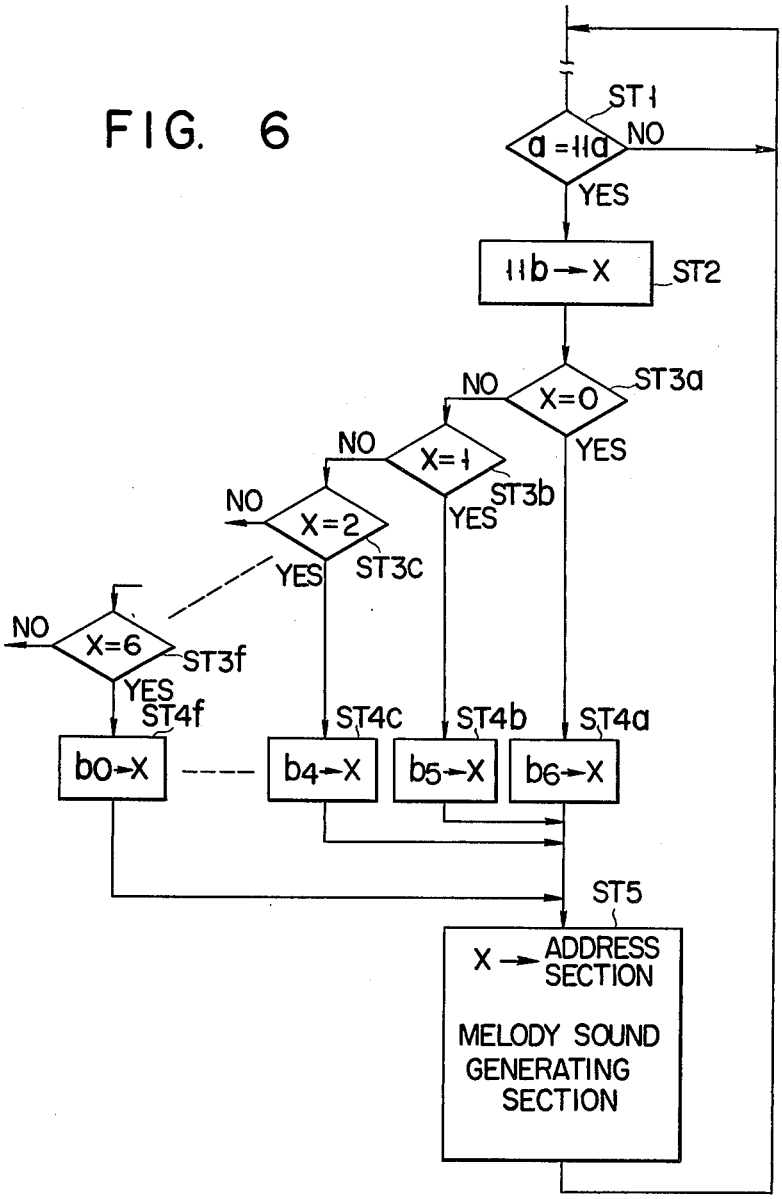
FIG. 6 is a flow chart for illustrating an alarm operation of the alarm sound.

FIG. 6 shows a flow chart illustrating the operation of producing alarm sound at the alarm time. In the first place, in the key sampling state in the watch mode, a step $ST_1$ is executed. More particularly, the alarm time data from the a register and the time data from the time counter 11*a* of the timepiece circuit 11 are always supplied to the ALU 8, and in the step $ST_1$ the judging section 13 judges whether or not these two input data coincide, that is, whether or not the present time is the alarm time, namely "10:30". If "NO" yields in this step, the operation is returned to the previous key sampling state. If "YES" yields, the next step $ST_2$ is executed. In this step, the weekday data in the weekday counter 11*b* in the timepiece circuit 11 is transferred through the ALU 8 to and written in the X register. The data in the X register is read out to the ALU 8, and the following steps $ST_{3a}$, $ST_{3b}$, . . . , $ST_{3f}$ are executed. In these steps $ST_{3a}$ through $ST_{3f}$, whether or not the data transferred to the X register is respectively X=0, X=1, . . . , X=6 is checked. If X=0 is detected, it is Sunday, if X=2 is detected, it is Monday, if X=6 is detected, it is Saturday, and so forth. When X=0 a step $ST_{4a}$ is executed, when X=1 a step $ST_{4b}$ is executed, when X=2 a step $ST_{4c}$ is executed, when X=6 a step $ST_{4f}$ is executed, and so forth. Since the start address data $A_0$ to $G_0$ of the individual music numbers are memorized in respective bits $b_6$ to $b_0$ of the b register, on Sunday the data in the bit $b_6$ ($E_0$ in FIG. 5) is transferred to the X register in the step $ST_{4a}$, and on Monday the data in the bit $b_5$ ($C_0$ in FIG. 5) is transferred to the X register in the step $ST_{4b}$. Likewise, on Tuesday the data in the bit $b_4$ ($G_0$ in FIG. 5) is transferred to the X register in the step $ST_{4c}$, and on Saturday the data in the bit $b_0$ ($B_0$ in FIG. 5) is transferred to the X register in the step $ST_{4f}$. When either one of the steps $ST_{4a}$ to $ST_{4f}$ is ended, the next step $ST_5$ is executed. In this step, the data in the X register is read out and through the ALU 8 and judging section 13 to the address section 5. With the address data from the address section 5, an address shift is caused in the ROM 6, and an address for the number corresponding to the present weekday among the seven different numbers corresponding to the respective weekdays is specified, and the first musical sound code for this number is produced. This musical sound code is coupled through the ALU 8 to the musical sound signal generating circuit 14, which thus produces a musical sound signal according to the aforementioned musical sound code and the musical note signal from the musical note generating circuit 15, the musical sound signal thus produced being coupled to the sound generator 16. Thus, the first musical sound of the given number of music is produced from the sound generator 16. When the generation of the first musical sound is ended, the ROM 6 produces a microcommand for the next address NA, thus causing address shift in the ROM 6 to the next address. Thus, the ROM 6 produces the second musical sound code of the number. With the second musical sound code coupled to the musical sound signal generating circuit 14, the second sound of the number is produced from the sound generator 16. By the above repetitive operation, the given number of music is produced as alarm sound.

As has been shown, a desired number of music can be selected among a plurality of preset numbers to meet the taste of the user. Thus, it is possible to hear a peculiar number of music at the alarm time each weekday. In addition, the selection of music numbers can be readily done by merely operating corresponding ten keys. Further, by setting a peculiar number for each weekday, it is possible to know which weekday the present day is from the alarm sound.

While the above embodiment has been arranged such as to be able to provide different alarm sounds for the individual weekdays, it is also possible to arrange such as to provide different alarm sounds for the individual months or seasons.

Also, while in the above embodiment the time data and weekday data are obtained respectively from the time counter and weekday counter of the timepiece circuit, it is also possible to provide the RAM with an internal time counting register and obtain the time and weekday data with the operation of adding "1" to the content of the time counting register under time counting control of the ROM.

Further, while in the above embodiment the addresses for the first musical sound of musical numbers are memorized in the b register by operating the music number selection key "MS", this is by no means limitative. For example, it is possible to arrange such as to permit the numeral code corresponding to a number, for instance "1" for number A and "2" for number B, be directly registered in the b register at the time of the music number selection so that the address data for the first musical sound of the number corresponding to the registered numeral code may be supplied to the address section when the alarm time is detected.

Furthermore, while the above embodiment is directed to an electronic miniature computer, the invention may of course be applied to an electronic wristwatch having a calculator function as well.

What is claimed is:

1. A miniaturized electronic apparatus having an alarm sound producing function comprising:

key input means (4) having first keys (3*a*, 3*c*) operable to input data for presetting an alarm time, and second keys (3*a*, 3*e*) operable to input signals for preselecting kinds of alarm sounds;

alarm time memory means (a-register in RAM7) coupled to said key input means for storing alarm time data which is inputted by the operation of said first keys (3*a*, 3*c*);

key input control means (5, 6) coupled between said key input means and said memory means (7) for effecting such control as to store alarm time in said memory (7) upon operation of said first keys (3*a*, 3*c*);

time counting means (11) including first counting means (11*a*) for counting real time, and second counting means (11*b*) coupled to said first counting means for counting carry output from said first counting means over a predetermined time interval such that when the count made by said second counting means reaches a predetermined count value, it is reset to an initial count value and said second counting means performs a circulating count operation from the initial count value to said predetermined count value;

judging means (5, 6, 8, 13) coupled to said memory means and to said time counting means for comparing the count value of said time counting means with the alarm time data stored in said alarm time memory means and for judging whether or not both coincide with each other;

alarm sound designation data memory means (b register in RAM7) coupled to said second keys (3*a*, 3*e*) of said key input means through said key input control means (5, 6), in which, when said second keys (3*a*, 3*e*) are initially operated a number of times in such an order as to designate a sequence of the producing of alarm sounds, signals produced by the operation of said second keys are stored as alarm sound designation data after being converted by said key input control means (5, 6) to said alarm sound designation data, said number of times of operation said second keys corresponding to said predetermined count value of said second counting means;

control means (5, 6, 8, 13) coupled to said judging means, to said second counting means (11*b*) of said time counting means (11) and to said alarm sound designation data memory means (b register in RAM7) for enabling alarm sound designation data corresponding to said count value counted by said second counting means (11*b*) to be read out of said alarm sound designation data memory means (b register in RAM7) upon receipt of a judgment output obtained from said judging means (5, 6, 8, 13) when coincidence occurs between the alarm time data read out of said alarm time memory means (a register in RAM7) and real time data counted by said first counting means (11*a*) of said time counting means (11);

alarm sound data memory means (ROM6) coupled to said control means (5, 6, 8, 13) for enabling initially storing alarm sound data corresponding to said kinds of alarm sounds and for reading out the alarm sound data on a basis of the alarm sound designation data selected by said control means (5, 6, 8, 13); and sound producing means (14, 15, 16) coupled to said alarm sound data memory means (ROM6) for receiving the alarm sound data read out of said alarm sound data memory means and producing an alarm sound.

2. The miniaturized electronic apparatus of claim 1, wherein said alarm sound data memory means (ROM6) includes storage means for storing different kinds of alarm sound data equal in number to the number of count data counted by said second counting means of said time counting means (11).

3. The miniaturized electronic apparatus of claim 1, wherein said time counting means includes means for effecting a circulating count operation with seven counts as one cycle, one count being a count value corresponding to a one day interval.

4. The miniaturized electronic apparatus of claim 1, wherein said alarm sound data memory means comprises a read only memory (ROM) and means for enabling musical scale data and tone length data for producing a melody to be stored in said ROM at a predetermined address according to the kinds of alarm sounds.

5. The miniaturzied electronic apparatus of claim 1, wherein said key input control means (5, 6) enables data for designating a start address of said alarm sound data memory means (ROM6) to be stored in said alarm sound designation data memory means when said second keys (3*a*, 3*e*) are operated to input signals for preselecting the alarm sound of said key input means.

6. The miniaturized electronic apparatus of claim 1, wherein said second keys (3*a*, 3*e*) of said key input means (4) are numeral keys corresponding to said alarm sounds.

* * * * *